United States Patent [19]

Sauvage et al.

[11] Patent Number: 4,746,883

[45] Date of Patent: May 24, 1988

[54] EVANESCENT MODE MICROWAVE BANDPASS FILTER WITH A ROTATABLE CRANK SHAPE COUPLING ANTENNA

[75] Inventors: Marc Sauvage, Nanterre; Marie-Christine Henriot, Clichy, both of France

[73] Assignee: Alcatel Thomson Faiscaeux Hertziens, France

[21] Appl. No.: 874,183

[22] Filed: Jun. 13, 1986

[30] Foreign Application Priority Data

Jun. 13, 1985 [FR] France ..... 85 08966

[51] Int. Cl.[4] ..... H01P 1/20

[52] U.S. Cl. ..... 333/202; 333/210

[58] Field of Search ..... 333/202, 208, 209, 230, 333/210, 21 A, 21 R, 24 R, 24 C, 26

[56] References Cited

U.S. PATENT DOCUMENTS

| | | | |
|---|---|---|---|
| 2,395,165 | 2/1946 | Collard | 333/33 |
| 2,490,845 | 12/1949 | Sorg | 333/230 X |
| 2,910,659 | 10/1959 | Caroselli | 333/253 |
| 3,105,207 | 9/1963 | Capewell et al. | 333/115 |
| 3,214,684 | 10/1965 | Everitt | 333/230 X |
| 3,933,226 | 8/1976 | Affolter | 333/202 |
| 4,028,652 | 6/1977 | Wakino et al. | 333/202 X |
| 4,206,428 | 6/1980 | Kaegebein | 333/230 X |
| 4,414,516 | 11/1983 | Howard | 333/21 A |
| 4,551,694 | 11/1985 | Biehl et al. | 333/230 X |
| 4,578,655 | 3/1986 | Etienne et al. | 333/210 X |

FOREIGN PATENT DOCUMENTS

| | | |
|---|---|---|
| 975422 | 11/1961 | Fed. Rep. of Germany . |
| 1228011 | 11/1966 | Fed. Rep. of Germany . |
| 0114140 | 7/1984 | France . |
| 820550 | 9/1959 | United Kingdom . |
| 1190495 | 5/1968 | United Kingdom . |

*Primary Examiner*—Eugene R. Laroche
*Assistant Examiner*—Benny Lee
*Attorney, Agent, or Firm*—Sughrue, Mion, Zinn, Macpeak and Seas

[57] ABSTRACT

The microwave bandpass filter in the form of a cutoff frequency waveguide (1) or evanescent mode guide, being besides tunable within a range of frequencies and having at least one terminal (21, 22) of the coaxial type, has terminals each equipped with a crank-shaped coupling antenna (15) operable to be rotated about its longitudinal axis for filter tuning purposes.

4 Claims, 1 Drawing Sheet

EVANESCENT MODE MICROWAVE BANDPASS FILTER WITH A ROTATABLE CRANK SHAPE COUPLING ANTENNA

FIELD OF THE INVENTION

This invention relates to a microwave bandpass filter for "cutoff" waveguides, also known as evanescent mode transmission guides, said filter being also tunable in a range of frequencies and having at least one terminal of the coaxial type.

FIG. 1 appended hereto schematically illustrates a known type of tunable evanescent mode bandpass filter. In this figure, reference numeral 1 designates the filter casing in the form of a circular waveguide closed by two end plates 2 and 3. The numerals 4 through 7 designate four tunable resonators each of which is composed of a fixed resonator part (40, 50, 60, 70) and a moving part (41, 51, 61, 71) for tuning adjustment purposes, forming the four poles of the bandpass filter, and the numerals 8, 9 and 10 designate screws for adjusting the couplings between adjactent resonators. Lastly, the numerals 11 and 12 respectively designate the filter input and output terminals, conventionally consisting of a coaxial receptacle (110, 120), of the SMA type for instance, and of a rigid wire (111, 121) serving as an antenna, the end opposite from the coaxial receptacle whereof is soldered into the casing 1.

Tuning of the filter illustrated in FIG. 1 is obtained in a conventional manner by adjusting the spacing between the fixed resonator parts (40, 50, 60, 70) of the resonators (4, 5, 6, 7) and their moving parts (41, 51, 61, 71), on the one hand, and adjusting the couplings between these resonators by driving in to a greater or lesser extent the adjusting screws 8, 9 and 10, on the other hand.

With this type of known filter, the tuning thus obtained is not always optimal as, to make it so would require also adjusting the coupling between each of the terminals (11, 12) and the adjacent resonator (4, 7), which is obviously not possible since this coupling depends upon the distance between each terminal antenna (111, 121) and the nearest resonator (4, 7), which distance is fixed in construction. Neither is it possible, for lack of space, to introduce an adjusting screw between each antenna and its adjacent resonator.

The coupling between each terminal antenna and its adjacent resonator is therefore, in this type of prior art device, optimized by design midway through the frequency band. This brings about a degradation of the filter characteristics towards the ends of this frequency band. In order to obtain filters conserving good characteristics, it is therefore necessary to realize a plurality of filters, by dividing the frequency band into several sub-bands, so as to have one filter per sub-band, thus considerably complicating the filtering device and increasing its cost.

SUMMARY OF THE INVENTION

The object of the invention is an evanescent mode bandpass filter being continuously adjustable over a wide range of frequencies in a fine and gradual way, and enabling optimized filter characteristics to be obtained in the said frequency range. The inventive filter's main improvement resides in that each of its coaxial terminals is equipped with a coupling antenna in the form of a crank and in that means are provided for adjusting the coupling between the said antenna and the said filter, consisting in the rotation or "cranking" of said antenna about its longitudinal axis.

BRIEF DESCRIPTION OF THE DRAWINGS

The invention will be more readily understood in reading the following description of a preferred embodiment, made with reference to the appended drawings in which.

DESCRIPTION OF THE PREFERRED EMBODIMENT

Figure 1:
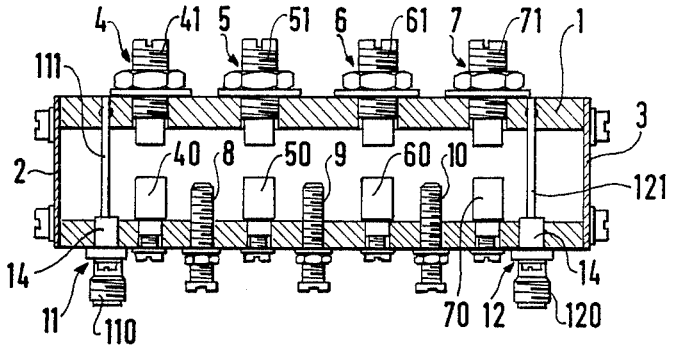
FIG.1 PRIOR ART
FIG. 1, already described, is a cut-away view of a tunable, evanescent mode, microwave bandpass filter according to the prior art.
Figure 2:
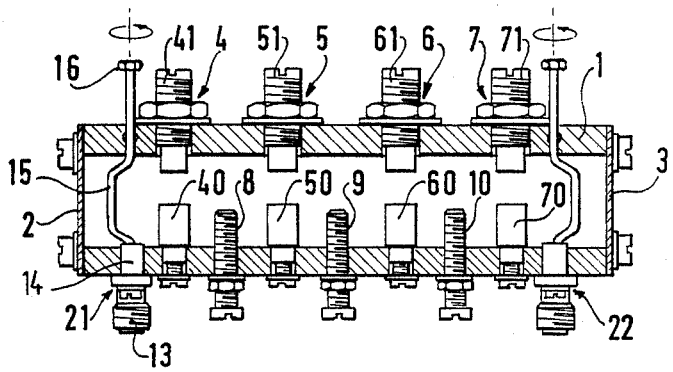
FIG. 2 is a view similar to that of FIG. 1, of a filter according to the invention.

In FIG. 2, illustrating a cross section of a four-pole microwave bandpass filter according to the invention, which is tunable and operates in evanescent mode, elements which are the same as previously described in FIG. 1 are designated by the same reference numerals and will therefore not be described again.

Figure 3:
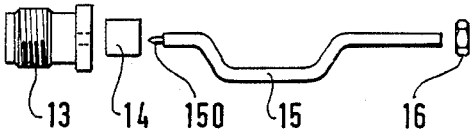
FIG. 3 is an exploded view of one of the terminal devices equipping the filter of FIG. 2.

The filter according to the invention shown in FIG. 2 features very special terminals, namely input terminal 21 and output terminal 22. As shown in the figure, and even more clearly in FIG. 3, each of these terminals consists of:

a coaxial receptacle 13, of the SMA type for example, an insulating bush 14, made for example of polytetrafluoroethylene (PTFE), designed to provide an insulated passage for the antenna through the wall of waveguide 1 (said bush 14 also existing in the prior art filter shown in FIG. 1), a crank-shaped coupling antenna 15, of wire form having axially aligned ends and an integral, intermediate U-shaped axially offset bend, as illustrated, preferably serving to wedge the antenna 15 inside the guide 1; said antenna 15 having an end of reduced cross section 150, intended to be tightly inserted into the coaxial receptacle 13, and a nut 16 welded onto the other end of the antenna 15, said end being located, as illustrated, outside the guide 1.

Figure 4:
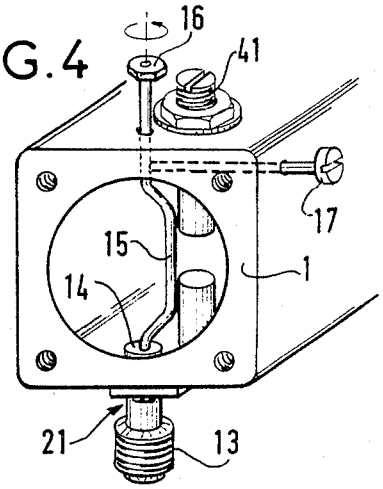
FIG. 4 is a partial view in perspective of the filter of FIG. 2 with the end plate removed.

The positioning of the terminal 21 in the guide 1 appears even more clearly in the perspective view, FIG. 4, which moreover shows a screw 17 for rotationally locking the antenna 15, by traversing the body 1 to the point of contacting and pressing against said antenna 15.

In the filter just described, the terminals 21, 22 can be coupled with the adjacent resonators 4, 7 in a precise and continuously variable manner.

Such fine coupling is operated by rotationally unlocking the given terminal, for instance terminal 21, by backing out screw 17, then rotating the crank-link antenna 15 with the help of nut 16, until the desired coupling is obtained. Thereafter, the antenna 15 is again secured in place by tightening screw 17.

For the trials made by the Assignee, the antenna 15 was made of non-annealed beryllium-bronze, with a thin surface coating of gold a few microns thick ensuring good electrical conductivity. The crank shape of the antenna 15 was realized by bending it in a mold—a method enabling good reproducibility. Due to the elasticity of the non-annealed beryllium-bronze alloy, it is possible to force the antenna 15 into the guide 1 through the bore provided for the insulating bush 14.

What is claimed is:

1. A tunable microwave bandpass filter operating in the evanescent mode, of the type comprising a waveguide body, at least one terminal of the coaxial type mounted to said waveguide body, the improvement wherein said terminal is equipped with a crank-shaped coupling antenna in the form of wire having axially aligned ends, and an integral, intermediate U-shaped axially offset bend therebetween, and means for mounting said antenna for rotation about a longitudinal axis aligned through said ends, for adjusting the coupling between said antenna and said filter, wherein said waveguide body filter comprises a filter casing having opposed, spaced waveguide walls and being closed by two end plates, and at least one tunable resonator comprising a fixed resonator part mounted to one waveguide wall coaxial with and spaced from an axial adjustable resonator part mounted to the other opposed waveguide wall, input and output terminals for said waveguide body filter mounted to one waveguide wall of said casing and adjacent said at least one tunable resonator, at least one of said input and output terminals comprising, a coaxial receptacle, a hole within a wall of the waveguide adjacent said at least one resonator, a bush mounted within said hole and said crank-shaped coupling antenna having one end thereof passing through said insulating bush and coupled to said coaxial receptacle and being rotatably coupled thereto, and wherein said crank-shaped coupling antenna has said integral, intermediate U-shaped axially offset bend disposed internally of said waveguide body.

2. The tunable microwave bandpass filter according to claim 1, wherein said one end of said wire form antenna coupled to said coaxial receptacle is of circular crosssection and of reduced cross-section relative to said U-shaped bend, and is tightly inserted into said coaxial receptacle and wherein, the other end of said antenna rotatably projects through the opposite wall of said waveguide body and wherein, a nut is threaded to said other end of said antenna whereby, rotation of said nut causes rotation of said antenna about its longitudinal axis.

3. The tunable microwave bandpass filter as claimed in claim 1, wherein said crank-shaped coupling antenna is of circular cross-section and said intermediate U-shaped bend has a radius sized to the diameter of the bush such that the crank-shaped coupling antenna passes through said hole within said one wall of said waveguide body and said bush is mounted within said waveguide body wall hole and wherein said other wall of said waveguide body includes a bore aligned with the hole within said one wall receiving said bush, said bore being of a diameter slightly larger than the diameter of the other end of said wire-form crank-shaped coupling antenna and said other end of said crank-shaped coupling antenna is rotatably received within said bore.

4. The tunable microwave bandpass filter as claimed in claim 2, wherein said crank-shaped coupling antenna is of circular cross-section and said intermediate U-shaped bend has a radius sized to the diameter of the bush such that the crank-shaped coupling antenna passes through said hole within said one wall of said waveguide body and said bush is mounted within said waveguide body wall hole and wherein said other wall of said waveguide body includes a bore aligned with the hole within said one wall receiving said bush, said bore being of a diameter slightly larger than the diameter of the other end of said wire-form crank-shaped coupling antenna and said other end of said crank-shaped coupling antenna is rotatably received within said bore.

* * * * *